US007952572B2

(12) United States Patent
Ko et al.

(10) Patent No.: US 7,952,572 B2
(45) Date of Patent: May 31, 2011

(54) IMAGE DATA DRIVING APPARATUS AND METHOD OF REDUCING PEAK CURRENT

(75) Inventors: Jae-Hong Ko, Seoul (KR); Seung-Jung Lee, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1034 days.

(21) Appl. No.: 11/756,030

(22) Filed: May 31, 2007

(65) Prior Publication Data

US 2008/0109605 A1 May 8, 2008

(30) Foreign Application Priority Data

Nov. 2, 2006 (KR) ..... 10-2006-0107713

(51) Int. Cl.
*G09G 5/00* (2006.01)

(52) U.S. Cl. ..... 345/204; 345/205; 345/207; 345/206; 345/208

(58) Field of Classification Search ..... 345/1.1, 345/55, 83, 87, 98, 539, 903, 13, 204–208; 348/565, 671, 625, 629, 441, 567, 563, 802, 348/383, 578; 711/122
See application file for complete search history.

(56) References Cited

U.S. PATENT DOCUMENTS 4,656,515 A * 4/1987 Christopher ..... 348/565
4,656,516 A * 4/1987 Fling et al. ..... 348/565
5,227,863 A * 7/1993 Bilbrey et al. ..... 348/578
5,523,772 A * 6/1996 Lee ..... 345/98
5,668,568 A * 9/1997 Holloman ..... 345/83
6,040,808 A * 3/2000 Knox et al. ..... 345/13
6,285,343 B1 * 9/2001 Brody ..... 345/1.1
6,683,596 B2 * 1/2004 Ozawa ..... 345/100
2002/0000969 A1 * 1/2002 Ozawa ..... 345/100
2002/0030649 A1 * 3/2002 Zavracky et al. ..... 345/87

FOREIGN PATENT DOCUMENTS

JP 2005-070673 3/2005
KR 1020060030403 A 4/2006

* cited by examiner

*Primary Examiner* — Prabodh M Dharia
(74) *Attorney, Agent, or Firm* — F. Chau & Associates, LLC

(57) ABSTRACT

A source driver includes a hold memory block, a pre-decoding block, a level shifting block and digital-to-analog (DAC) block. The hold memory block stores digital image data. The pre-decoding block generates a data code that includes at least one bit having a first logic level based on the digital image data and generates a plurality of enable signals based on the data code. The level shifting block performs level shifting of the data code based on the enable signals. The DAC block outputs a grayscale voltage that is selected based on the level shifted data code output from the level shifting block. A source driver module and a display device include a plurality of the source drivers.

19 Claims, 11 Drawing Sheets

FIG. 8

| LOWER BIT | | | FIRST DATA CODE | | | | | | | | FIRST ENABLE SIGNAL | | | |
|---|---|---|---|---|---|---|---|---|---|---|---|---|---|---|
| D1 | D2 | D3 | C1 | C2 | C3 | C4 | C5 | C6 | C7 | C8 | E1 | E2 | E3 | E4 |
| 0 | 0 | 0 | 1 | 0 | 0 | 0 | 0 | 0 | 0 | 0 | 0 | 1 | 1 | 1 |
| 0 | 0 | 1 | 0 | 1 | 0 | 0 | 0 | 0 | 0 | 0 | 0 | 1 | 1 | 1 |
| 0 | 1 | 0 | 0 | 0 | 1 | 0 | 0 | 0 | 0 | 0 | 1 | 0 | 1 | 1 |
| 0 | 1 | 1 | 0 | 0 | 0 | 1 | 0 | 0 | 0 | 0 | 1 | 0 | 1 | 1 |
| 1 | 0 | 0 | 0 | 0 | 0 | 0 | 1 | 0 | 0 | 0 | 1 | 1 | 0 | 1 |
| 1 | 0 | 1 | 0 | 0 | 0 | 0 | 0 | 1 | 0 | 0 | 1 | 1 | 0 | 1 |
| 1 | 1 | 0 | 0 | 0 | 0 | 0 | 0 | 0 | 1 | 0 | 1 | 1 | 1 | 0 |
| 1 | 1 | 1 | 0 | 0 | 0 | 0 | 0 | 0 | 0 | 1 | 1 | 1 | 1 | 0 |

IMAGE DATA DRIVING APPARATUS AND METHOD OF REDUCING PEAK CURRENT

CROSS-REFERENCE TO RELATED PATENT APPLICATIONS

This application claims priority to Korean Patent Application No. 10-2006-0107713 filed on Nov. 2, 2006, the disclosure of which is incorporated by reference in its entirety herein.

BACKGROUND OF THE INVENTION

1. Technical Field

The present disclosure relates to a source driver and more particularly, to an apparatus and method for driving image data which reduces a peak current.

2. Discussion of the Related Art

A conventional display device may include a source driver, a gate driver, and a pixel array. When digital image data is displayed or stored in the pixel array of the display device, the gate driver sequentially drives a plurality of gate lines and the source driver displays or stores the digital image data in pixels of the pixel array connected to a driven gate line.

FIG. 1 is a block diagram of a conventional source driver 10. Referring to FIG. 1, the source driver 10 includes a shift register block 20, a sampling memory block 30, a hold memory block 40, a level shifting block 50, a digital-to-analog converter (DAC) block 60, a grayscale voltage generation unit 65, and an output buffer block 70.

The shift register block 20 shifts a start pulse signal SP input from a controller (not shown) in response to a clock signal CLK. The sampling memory block 30 samples digital image data R/G/B input from the controller in response to signals S1 through Sn (where n is an integer) output from the shift register block 20. The hold memory block 40 stores the sampled digital image data R/G/B for a horizontal scan time.

The hold memory block 40 is driven at a low voltage, for example, 0.6V-3.3V, and the DAC block 60 and the output buffer block 70 are driven at a high voltage, for example, 3.8V-18V. The level shifting block 50 changes the voltage level of the digital image data R/G/B stored in the hold memory 40 and provides digital image data RIG/B with a changed voltage level to the DAC block 60.

The DAC block 60 outputs a voltage from a plurality of grayscale voltages V0-Vz (where z is an integer) generated from the grayscale voltage generation unit 65 to the output buffer block 70 based on the digital image data with the changed voltage level. The output buffer block 70 outputs the voltage output from the DAC block 60 to channels CH1 through CHn.

FIG. 2 is a block diagram 200 of a single channel for 6 bit digital image data R/G/B of the source driver 10 shown in FIG. 1. Referring to FIG. 2, the hold memory block 40 includes six latches 211 through 216 for storing the 6 bit digital image data signal R/G/B sampled by the sampling memory block 30. The level shifting block 50 includes six level shifters 221 through 226 for performing level shifting of an output voltage of each of the latches 211 through 216.

The DAC block 60 selects and outputs one of the grayscale voltages V0-Vz (z=63) of 64 levels based on the outputs of the six level shifters 221 through 226. The DAC block 60 can be embodied by a binary search DAC having 128 transistors. Each of the level shifters 221 through 226 can be embodied by using differential amplifiers. Bit data D1 and inverted bit data DB1 of the digital image data is input to input terminals of the differential amplifiers.

FIG. 3 is a circuit diagram of the level shifter 221 of FIG. 2. Referring to FIG. 3, the bit data D1 and inverted bit data DB1 of the digital image data is input to the level shifter 221. The level of the bit data D1 may transition. For example, the bit data D1 of the digital image data can be transitioned from bit data "0" of a second logic level to bit data "1" of a first logic level.

As soon as the transition occurs, transistors T1, T2, and T3 of the level shifter 221 can be simultaneously turned on. A peak current can be generated between a supply voltage VDD and a ground voltage VSS of the level shifter 221.

The source driver 10 outputs the 6 bit digital image data D1 through D6 to the six level shifters 221 through 226 of FIG. 2 while the six level shifters 221 through 226 are all operated. Thus, peak currents corresponding to the six level shifters 221 through 226 per channel of the source driver 10 can be generated.

Since a high voltage for example, a VDD of 18V, is used for the operation of the level shifters 221 through 226, a large amount of power may be consumed due to the peak current. Therefore, it is necessary to reduce the peak current in the source driver.

SUMMARY OF THE INVENTION

According to an exemplary embodiment of the present invention, a source driver includes a hold memory block, a pre-decoding block, a level shifting block, and a digital-to-analog converter (DAC) block. The hold memory block stores digital image data. The pre-decoding block generates a data code that includes at least one bit having a first logic level based on the digital image data and generates a plurality of enable signals based on the data code. The level shifting block performs level shifting of the data code based on the enable signals. The DAC block outputs a grayscale voltage that is selected based on the level shifted data code output from the level shifting block.

According to an exemplary embodiment of the present invention, a source driver module includes a plurality of the above-described source drivers.

According to an exemplary embodiment of the present invention, a display device includes a display panel, a gate driver, and a plurality of source drivers. The display panel has a plurality of gate lines, a plurality of source lines, and a plurality of pixels. The gate driver drives the gate lines. The plurality of source drivers are electrically connected to the source lines.

Each of the source drivers includes a hold memory block, a pre-decoding block, a level shifting block, and a digital-to-analog converter (DAC) block. The hold memory block stores digital image data. The pre-decoding block generates a data code that includes at least one bit having a first logic level based on the digital image data and generates a plurality of enable signals based on the data code.

The level shifting block performs level shifting of the data code based on the enable signals. The DAC block outputs a grayscale voltage that is selected based on the level shifted data code output from the level shifting block. The output buffer block outputs the grayscale voltage output from the DAC block to a corresponding source line of the source lines According to an exemplary embodiment of the present invention, a method for performing level shifting of digital image data of a source driver is provided. The method includes a pre-decoding operation, a level shifting operation, and an outputting operation. In the pre-decoding operation, a data code that includes at least one bit having a first logic level is generated based on the digital image data and a plurality of enable signals are generated based on the data code. In the level shifting operation, level shifting of the data code based on the enable signals is performed. In the outputting operation, a grayscale voltage that is selected based on the level shifted data code is output.

According to an exemplary embodiment of the present invention, a predecoder and a default high level shifter are applied to reduce a peak current between a high voltage power source and a ground voltage in an LCD driver IC (LDI). For example, when the LDI includes a source driver having a DAC, the size of the DAC can be reduced.

The predecoder may decode in advance a 6-bit digital image data by selecting from 64 grayscale (G/S) voltages output by an output buffer of the source driver so that a transition of data of the level shifter at a front end of the output buffer of the source driver can be minimized.

The uppermost three bits of the 6-bit digital image data may be changed to a first 8-bit data code or a column data code and the lowermost three bits of the 6-bit digital image data may be changed to a second 8-bit data code or a row data code. A single bit of the first 8-bit data code and a single bit in the second 8-bit data code may be transmitted to the level shifter. The single bits may have a first logic level, for example, a logic high level and the other 7 bits in each column data code and row data code may be transmitted to the level shifter, having a second logic level, for example, a logic low level.

BRIEF DESCRIPTION OF THE DRAWINGS

The above and other features of the present invention will become more apparent by describing in detail exemplary embodiments thereof with reference to the attached drawings in which:

FIG. 8 is a truth table showing decoding results of the first pre-decoding unit of FIG. 7;

DETAILED DESCRIPTION OF EXEMPLARY EMBODIMENTS

Figure 1:
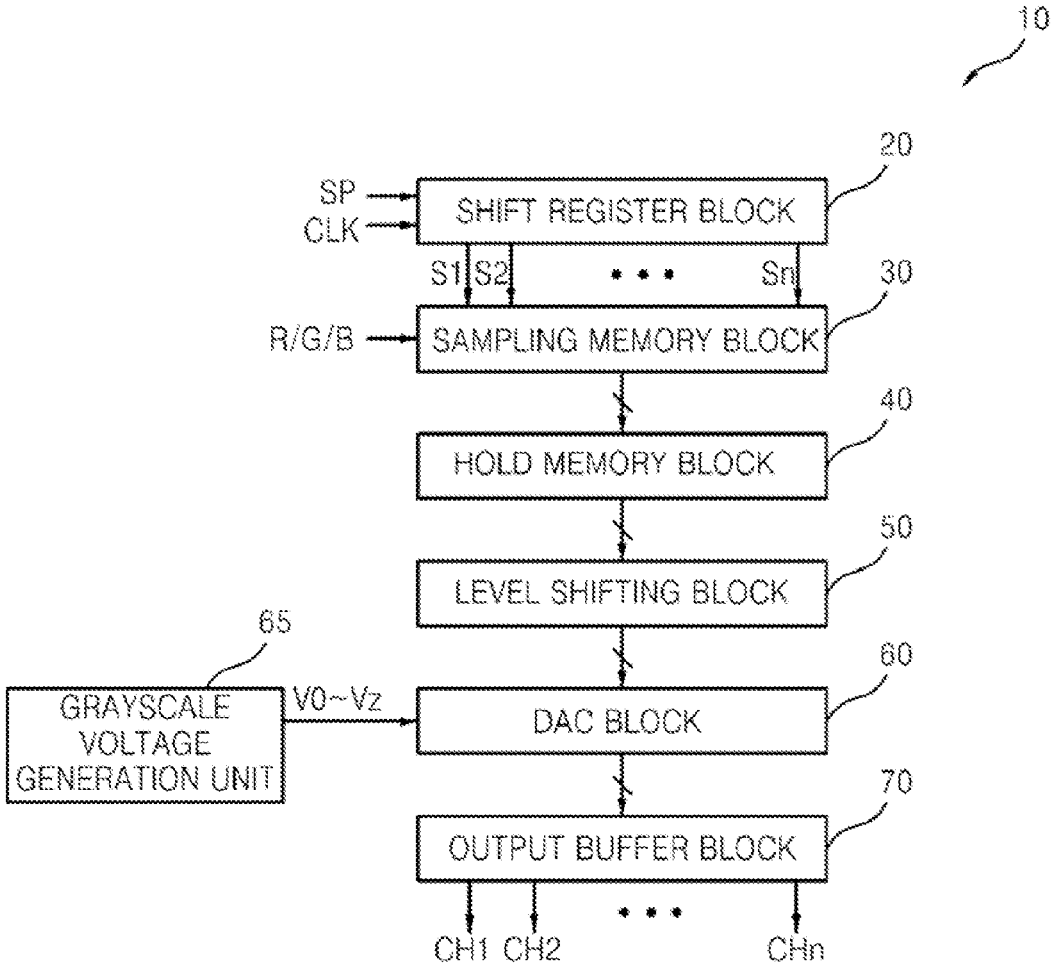
FIG. 1(PRIOR ART)
FIG. 1 is a block diagram of a conventional source driver.
Figure 4:
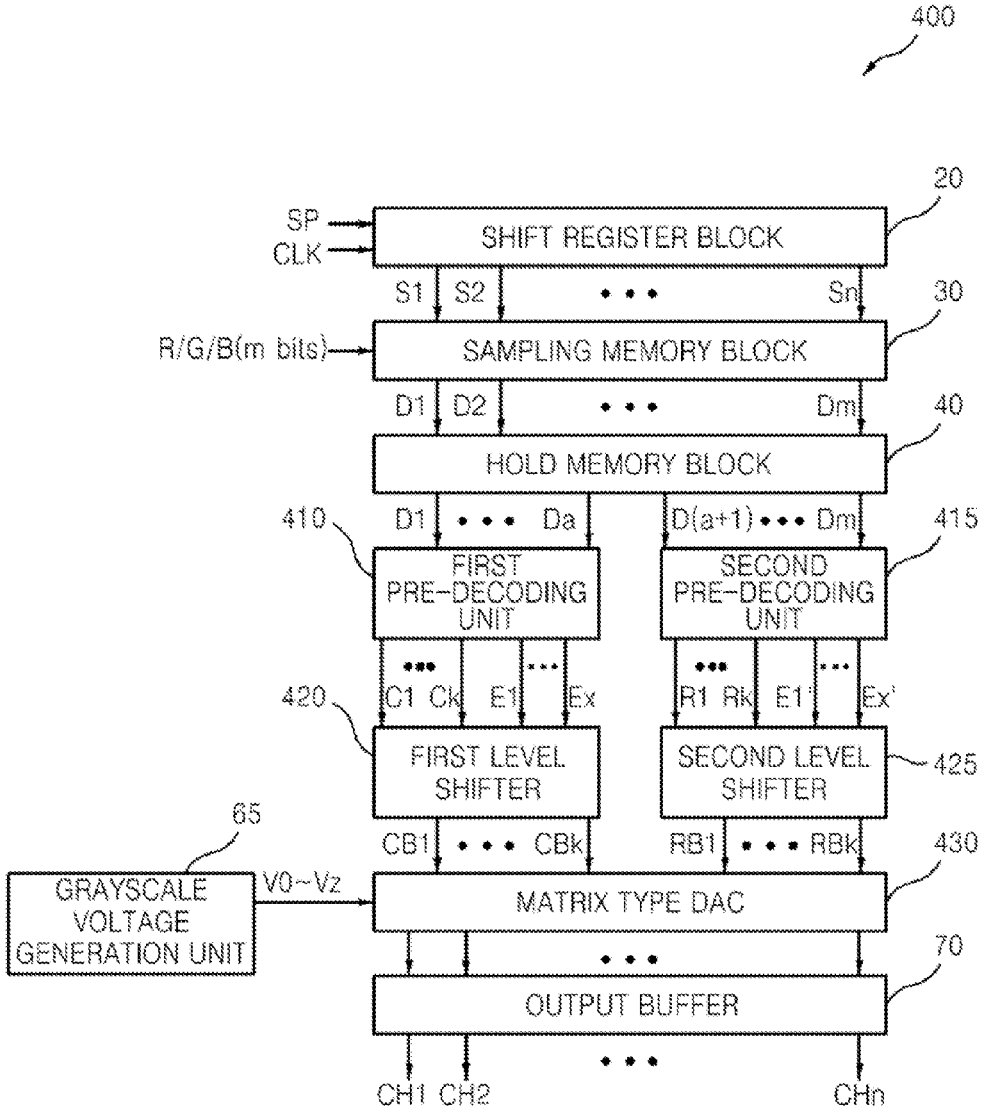
FIG. 4 is a block diagram of a source driver according to an exemplary embodiment of the present invention.

FIG. 4 is a block diagram of a source driver 400 according to an exemplary embodiment of the present invention. Referring to FIG. 4, the source driver 400 includes a shift register block 20, a sampling memory block 30, a hold memory block 40, pre-decoding blocks 410 and 415, level shifting blocks 420 and 425, a matrix type DAC block 430, and an output buffer block 70. Since the shift register block 20, the sampling memory block 30, the hold memory block 40, and the output buffer block 70 are the same as those described with reference to FIG. 1, descriptions thereof will be omitted herein.

The pre-decoding blocks 410 and 415 respectively generate data codes C1 through Ck (where k is an integer) and R1 through Rk that include at least one bit having a first logic level, for example, 1, based on digital image data R/G/B of m (where m is an integer) bits stored in the hold memory block 40. The pre-decoding bocks 410 and 415 also respectively generate a plurality of enable signals E1 through Ex (where x is an integer) and E1' through Ex' based on the data codes C1 through Ck and R1 through Rk.

The pre-decoding blocks 410 and 415 respectively generate a first data code C1 through Ck and a second data code R1 through Rk based respectively on predetermined lower bits D1 through Da (where a is an integer, and 1<a<<m) and upper bits D(a+1) through Dm of the m bits of digital image data R/G/B. The pre-decoding blocks 410 and 415 respectively generate first enable signals E1 through Ex based on logic level values of neighboring bits in the first data code C1 through Ck and second enable signals E1' through Ex' based on logic level values of neighboring bits in the second data codes R1 through Rk.

The pre-decoding blocks 410 and 415 include a first pre-decoding unit 410 and a second pre-decoding unit 415.

Figure 5:
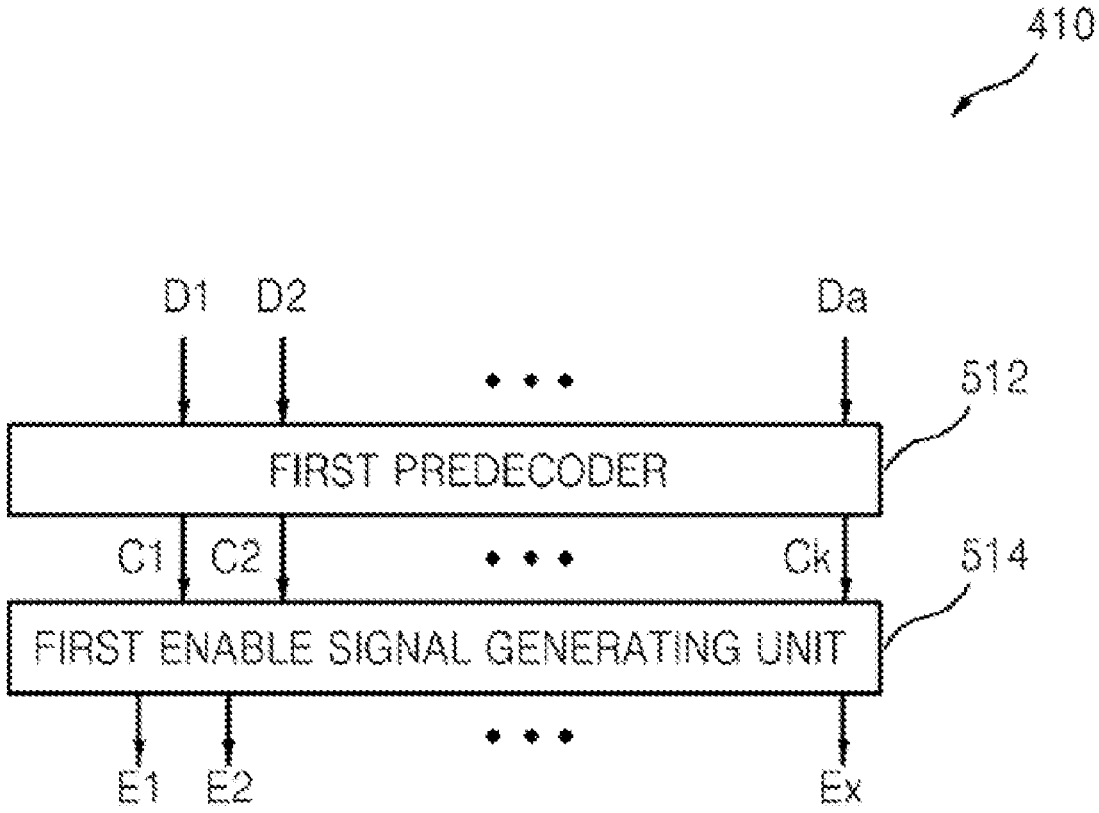
FIG. 5 is a block diagram of a first pre-decoding unit of FIG. 4.

FIG. 5 is a block diagram of the first pre-decoding unit of FIG. 4. Referring to FIGS. 4 and 5, the first pre-decoding unit 410 includes a first predecoder 512 and a first enable signal generating unit 514.

The first predecoder 512 generates the first data code C1 through Ck that includes at least one bit having the first logic level, for example, 1, based on the predetermined lower bits D1 through Da of the m bits of digital image data R/G/B. The first enable signal generating unit 514 generates the first enable signals E1 through Ex based on the logic level values of the neighboring bits of the first data codes C1 through Ck.

The second pre-decoding unit 415 has the same structure as the first pre-decoding unit 410 except for input and output signals. The second pre-decoding unit 415 includes a second pre-decoder (not shown) generating the second data codes R1 through Rk and a second enable signal generating unit (not shown) generating second enable signals E1' through Ex'.

The level shifting blocks 420 and 425 respectively perform level shifting of the data codes C1 through Ck and R1 through Rk based on the respective enable signals E1 through Ex and E1' through Ex'. The level shifting blocks 420 and 425 include a first level shifting unit 420 having a plurality of first level shifters (not shown) and a second level shifting unit 425 having a plurality of second level shifters (not shown).

Each of the first level shifters performs level shifting of voltages of the neighboring bits, for example, C1 and C2, in the first data code C1 through Ck based on a corresponding first enable signal, for example, E1, of the first enable signals E1 through Ex. In addition, each of the first level shifters performs level shifting of the neighboring bits, for example, C1 and C2, to have the first logic level value, for example, 1 when the neighboring bits, for example, C1 and C2, have the second logic level value, for example, 0.

Likewise, each of the second level shifters performs level shifting of voltages of the neighboring bits, for example, R1 and R2, in the second data code R1 through Rk based on a corresponding second enable signal, for example, E1', of the second enable signals E1' through Ex'. In addition, each of the second level shifters performs level shifting of the neighboring bits, for example, C1 and C2, to have the second logic level value, for example, 1, when the neighboring bits, for example, R1 and R2, have the second logic level value, for example, 0.

The matrix type DAC block 430 selects one of the grayscale voltages, for example, V0 through Vz, supplied from the grayscale voltage generation unit 65 based on the level shifted data codes CB1 through CBK and RB1 through RBK output from the level shifting blocks 420 and 425 and outputs the selected grayscale voltage to the output buffer block 70.

Figure 6:
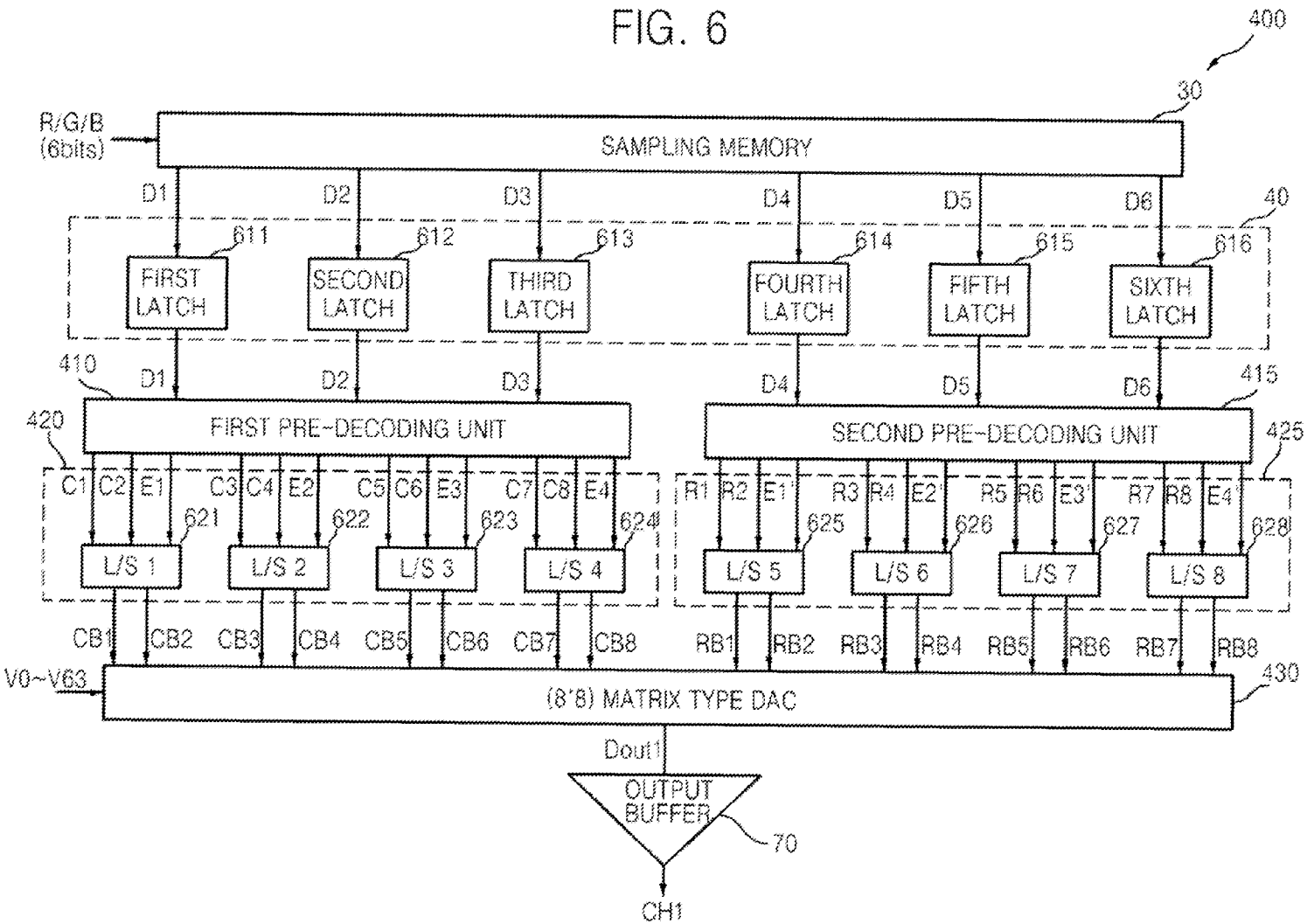
FIG. 6 is a block diagram of a single channel of the source driver for 6 bit digital image data according to an exemplary embodiment of the present invention.

FIG. 6 is a block diagram of a single channel of the source driver 400 for 6 bit digital image data according to an exemplary embodiment of the present invention. Referring to FIG. 6, the hold memory block 40 includes six latches 611 through 616 for storing 6 bits of digital image data D1 through D6 sampled by the sampling memory block 30. The lower 3 bits D1, D2, and D3 of the 6 bit digital image data D1 through D6 are respectively stored in the first, second, and third latches 611, 612, and 613 while the upper 3 bits D4, D5, and D6 are respectively stored in the fourth, fifth, and sixth latches 614, 615, and 616.

The first pre-decoding unit 410 decodes the lower 3 bits D1, D2, and D3 and generates decoded 8-bit first data code C1 through C8. The first data code C1 through C8 includes at least one bit having a first logic level, for example, 1. The first pre-decoding unit 410 generates the first enable signals E1 through E4 based on the logic level values of the neighboring bits in the first data code C1 through C8.

Likewise, the second pre-decoding unit 415 decodes the upper 3 bits D4, D5, and D6 and generates decoded 8-bit second data code R1 through R8. The second data code R1 through R8 includes at least one bit having a first logic level, for example, 1. The second pre-decoding unit 415 generates the second enable signals E1' through E4' based on the logic level values of the neighboring bits in the second data codes R1 through R8.

Figure 7:
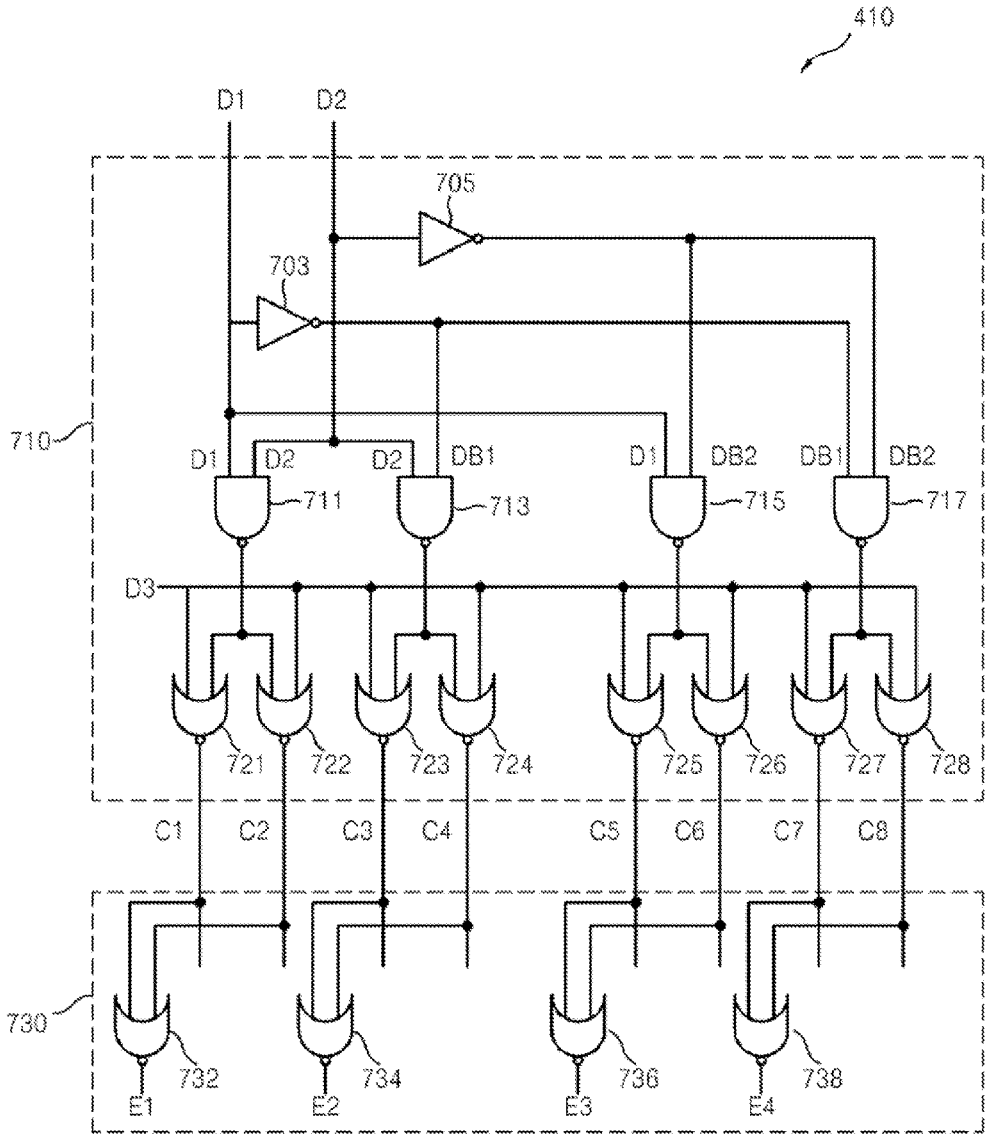
FIG. 7 is a circuit diagram of a first pre-decoding unit of FIG. 6.

FIG. 7 is a circuit diagram of the first pre-decoding unit 410 of FIG. 6. Referring to FIG. 7, the first pre-decoding unit 410 includes a first predecoder 710 and a first enable signal generation unit 730.

The first predecoder 710 includes two inverters 703 and 705 four NAND gates 711 through 717, and eight first NOR gates 721 through 728. Each of the inverters 703 and 705 inverts two bits, for example, D1 and D2, selected from the lower three bits D1, D2, and D3 and outputs inverted bits, for example, DB1 and DB2. Each of the NAND gates 711 through 717 performs a logic operation on the selected two bits, for example, D1 and D2, and the inverted bits, for example, DB1 and DB2, and outputs the result of the logic operation.

Each of the first NOR gates 721 and 728 performs a logic operation on a corresponding output of the outputs of the NAND gates 711 through 717 and the unselected other bit, for example, D3, of the lower three bits D1, D2, and D3, and outputs the result of the logic operation. The eight bit data code output from the first NOR gates 721 through 728 respectively become the first data code C1 through C8.

The first enable signal generation unit 730 includes four second NOR gates 732 through 738. Each of the second NOR gates 732 through 738 performs a logic operation on neighboring bits of the 8-bit first data code C1 through C8, for example, C1 and C2, C3 and C4, C5 and C6, and C7 and C8, and outputs the result of the logic operation. The four outputs from the second NOR gates 732 through 738 respectively become the first enable signals E1 through E4.

When the neighboring bits, for example, C1 and C2, C3 and C4, C5 and C6, and C7 and C8, in the 8-bit first data code C1 through C8 have the second logic level value "0", each of the first enable signals E1 through E4 has the first logic level value "1". Likewise, the second pre-decoding unit 415 of FIG. 6 has the same structure as the first pre-decoding unit 410 of FIG. 7 except for the input and output signals.

The first pre-decoding unit 410 of FIG. 7 decodes the 3 lower bits D1 through D3 of the digital image data D1 through D6. As a result of the decoding, one bit of the 8-bit first data code C1 through C8 has the first logic level value, for example, 1 and the other bits have the second logic level value, for example, 0.

The first pre-decoding unit 410 of FIG. 7 is merely an exemplary embodiment, as the present invention is not limited thereto. The first pre-decoding unit 410 can be embodied to generate the first data code C1 through C8 including two or more bits having the first logic level values for example, 1, based on the lower bits D1 through D3. Inverters for inverting at least one of the outputs of the level shifting block are needed to select the grayscale voltage.

FIG. 8 is a truth table showing the decoding results of the first pre-decoding unit 410 of FIG. 7. Referring to FIGS. 7 and 8, the 8-bit first data code C1 through C8, which includes one bit having the first logic level, for example, 1, based on the lower bits D1 through D3, is generated. Each of the neighboring bits, for example, C1 and C2, C3 and C4, C5 and C6, or C7 and C8, in the first data code C1 through C8 is logically operated on by each of the second NOR gates 732 through 738 of FIG. 7.

When the neighboring bits, for example, C1 and C2, C3 and C4, C5 and C6, or C7 and C8, have the second logic level value, for example, 0, each of the corresponding first enable signals E1 through E4 has the first logic level value, for example, 1, otherwise, each of the first enable signals E1 through E4 has the second logic level value, for example, 0.

A truth table showing the decoding results of the second pre-decoding unit 415 of FIG. 6 would be similar to that of the first pre-decoding unit 410 of FIG. 8. Thus, data codes generated as a result of the decoding that correspond to the respective upper and lower bits of the digital image data D1 through D6 can be a total of 64 different data codes.

The level shifting blocks 420 and 425 respectively perform level shifting of the first data code C1 through C8 and the second data code R1 through R8 based respectively on the enable signals E1 through E4 and E1' through E4'. The level shifting blocks 420 and 425 include the first level shifting unit 420 and the second level shifting unit 425. The first level shifting unit 420 includes four first level shifters 621 through 624. Each of the first level shifters 621 through 624 performs level shifting for each of the neighboring bits for example, C1 and C2, C3 and C4, C5 and C6, or C7 and C8, in the first data code C1 through C8 based respectively on each of the first enable signals E1 through E4 output from the first pre-decoding unit 410.

Figure 9:
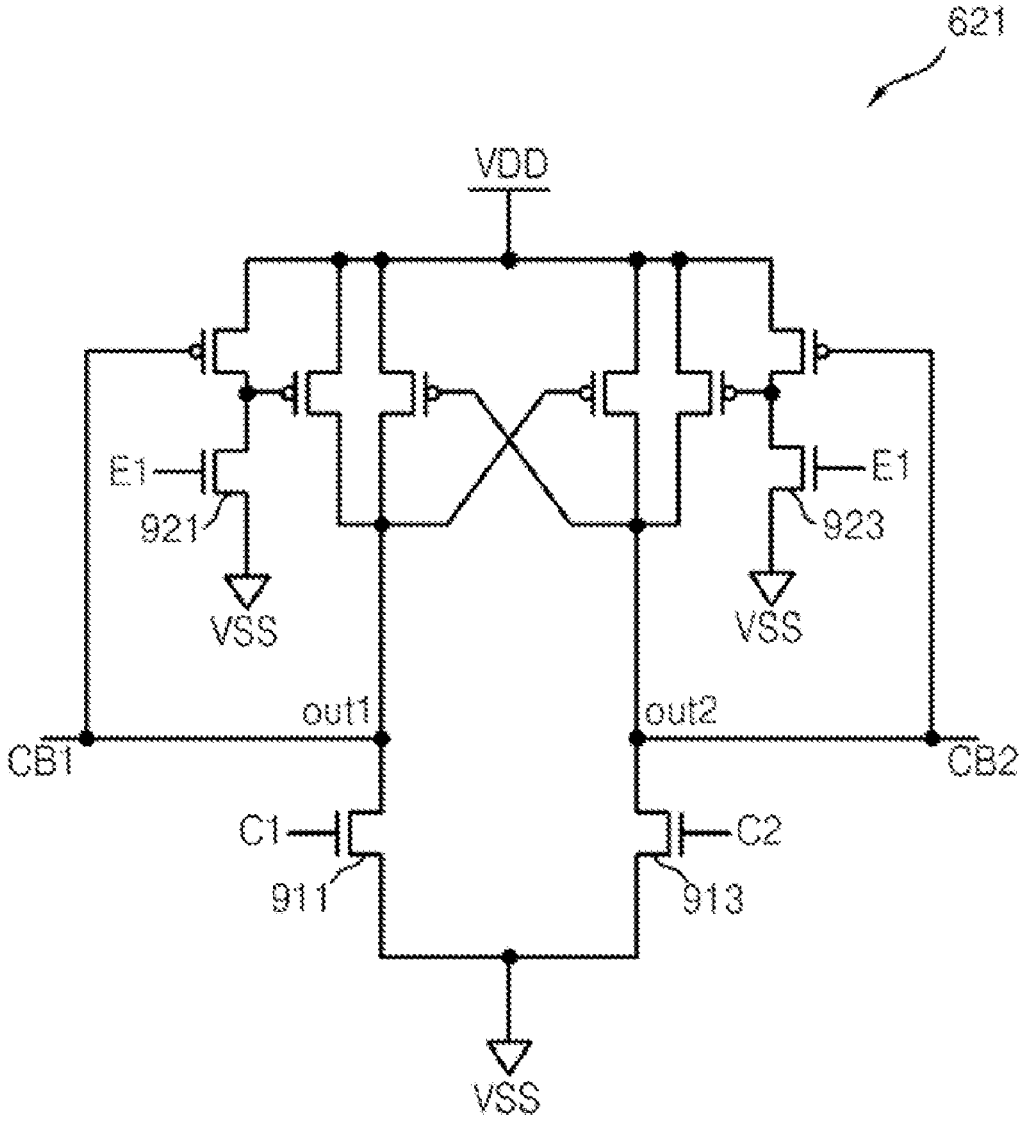
FIG. 9 is a circuit diagram of a first level shifter of FIG. 6.

FIG. 9 is a circuit diagram of the first level shifter of FIG. 6. Each of the first level shifters 621 through 624 has the same structure except for the input and output signals. Referring to FIG. 9, the first level shifter 621 can be embodied using differential amplifiers.

The first level shifter 621 performs level shifting of the neighboring bits C1 and C2 input to each of the gate terminals of a pair of differential amplification transistors 911 and 913. The differential amplification transistors 911 and 913 can be a pair of NMOS transistors. C1 and C2 are inverted, level shifted and respectively output as outputs CB1 and CB2 to terminals out1 and out2 of the level shifter 621 according to the characteristic of the differential amplifier.

When the neighboring bits, for example, C1 and C2, have the second logic level value, for example, 0, the first level shifter 621 may not be operated. When all of the neighboring bits, for example, C1 and C2, have the second logic level value, for example, 0, the first level shifter 621 may be embodied such that all of the outputs out1 and out2 of the first level shifter 621 default to a logic high level.

When the neighboring bits, for example, C1 and C2, have the second logic level value, for example, 0, as shown in FIG. 7, the first enable signals, for example, E1, has the first logic level value, for example, 1. In response to the first enable signal, for example, E1, each of the enable transistors 921 and 923 of the first level shifter 621 is turned on and all of the outputs, for example, CB1 and CB2, of the first level shifter 621 have the high level value. For this reason the first level shifter 621 is referred to as a default high level shifter.

When the first enable signal E1 is in the first logic level, for example, 1, the enable transistors 921 and 923 are turned on and the outputs CB1 and CB2 of the first level shifter 621 are in the logic high level. When the enable signal E1 is in the first logic level, for example, 1 the first level shifter 621 remains idle. When the enable signal E1 is in the second logic level, for example, 0, the first level shifter 621 performs a level shifting operation.

When the first level shifter 621 remains idle, the differential amplification transistors 911 and 913 of FIG. 9 are turned off so that a current path between the power voltage VDD and the ground voltage VSS does not exist. The peak current is not generated in the level shifter 621. Thus, only one of the first level shifters 621 through 624 and only one of the second level shifters 625 through 628, for example, the level shifters 621 and 625, are operated per channel of the source driver 400 of FIG. 6 while the other level shifters, for example, 622 through 624 and 626 through 628, remain idle.

For example, according to the truth table of FIG. 8, when the first data code C1 through C8 corresponding to the lower three bits D1 through D3 of the digital image data D1 through D6 is 10000000, only one level shifter 621 of the first level shifters 621 through 624 is operated while the other first level shifters 622 through 624 are not operated.

According to the truth table of FIG. 8, since the first data code C1 through C8 includes only one bit having the first logic level, for example, 1, any one of the first level shifters 621 through 624 is operated while the others remain idle. Likewise, for the second data code R1 through R8 corresponding to the upper three bits D4 through D6 of the digital image data D1 through D6, any one of the second level shifters 625 through 628 is operated while the others remain idle.

Figure 2:
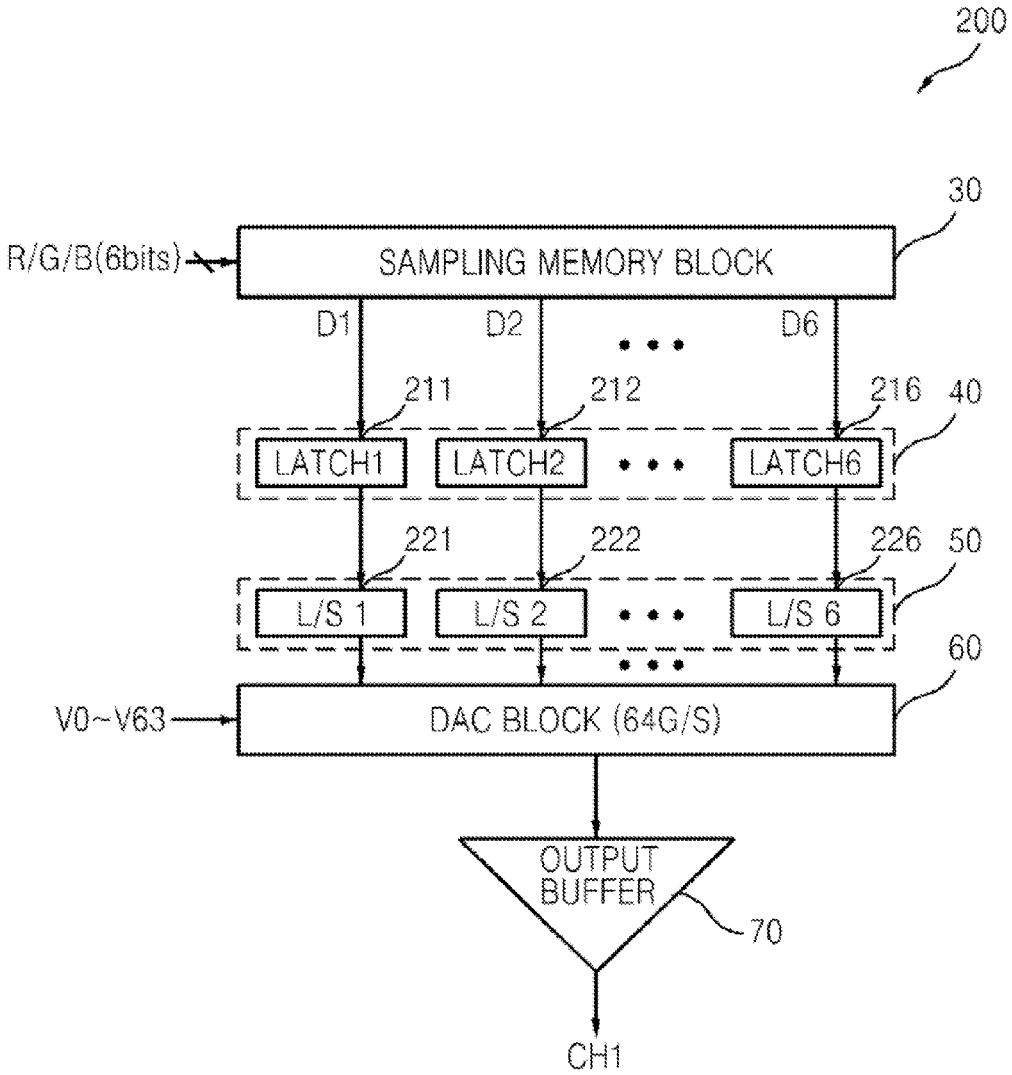
FIG. 2(PRIOR ART)
FIG. 2 is a block diagram of a single channel for 6 bit digital image data of the source driver of FIG. 1.
Figure 3:
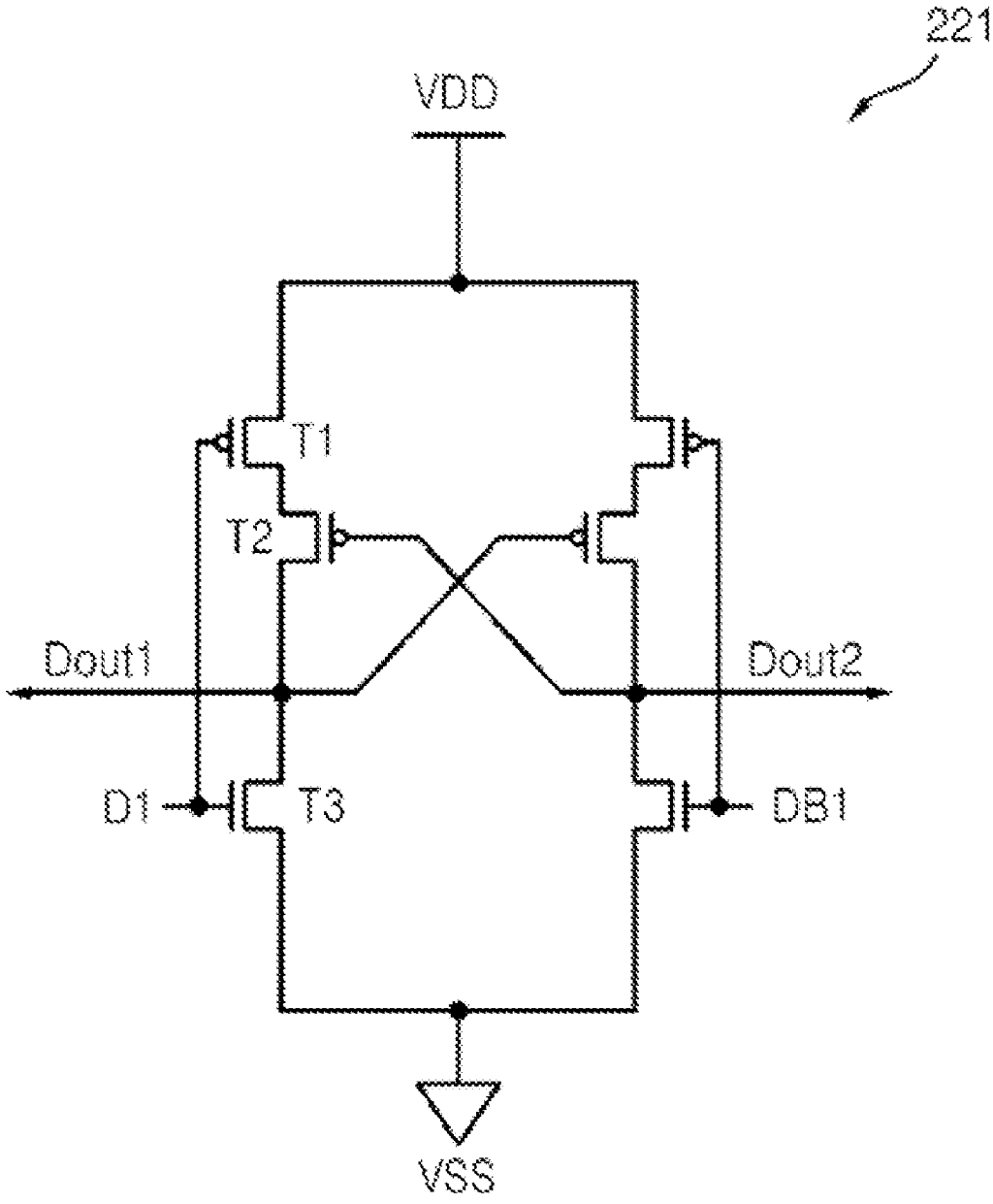
FIG. 3(PRIOR ART)
FIG. 3 is a circuit diagram of the level shifter of FIG. 2.

Thus, when the 6-bit digital image data D1 through D6 is decoded and level shifted, since only one of the first level shifters 621 through 624 and only one of the second level shifters 625 through 628 are operated, the peak current can be reduced to ⅓ the peak current generated per channel of the source driver 200 of FIG. 2.

Figure 10:
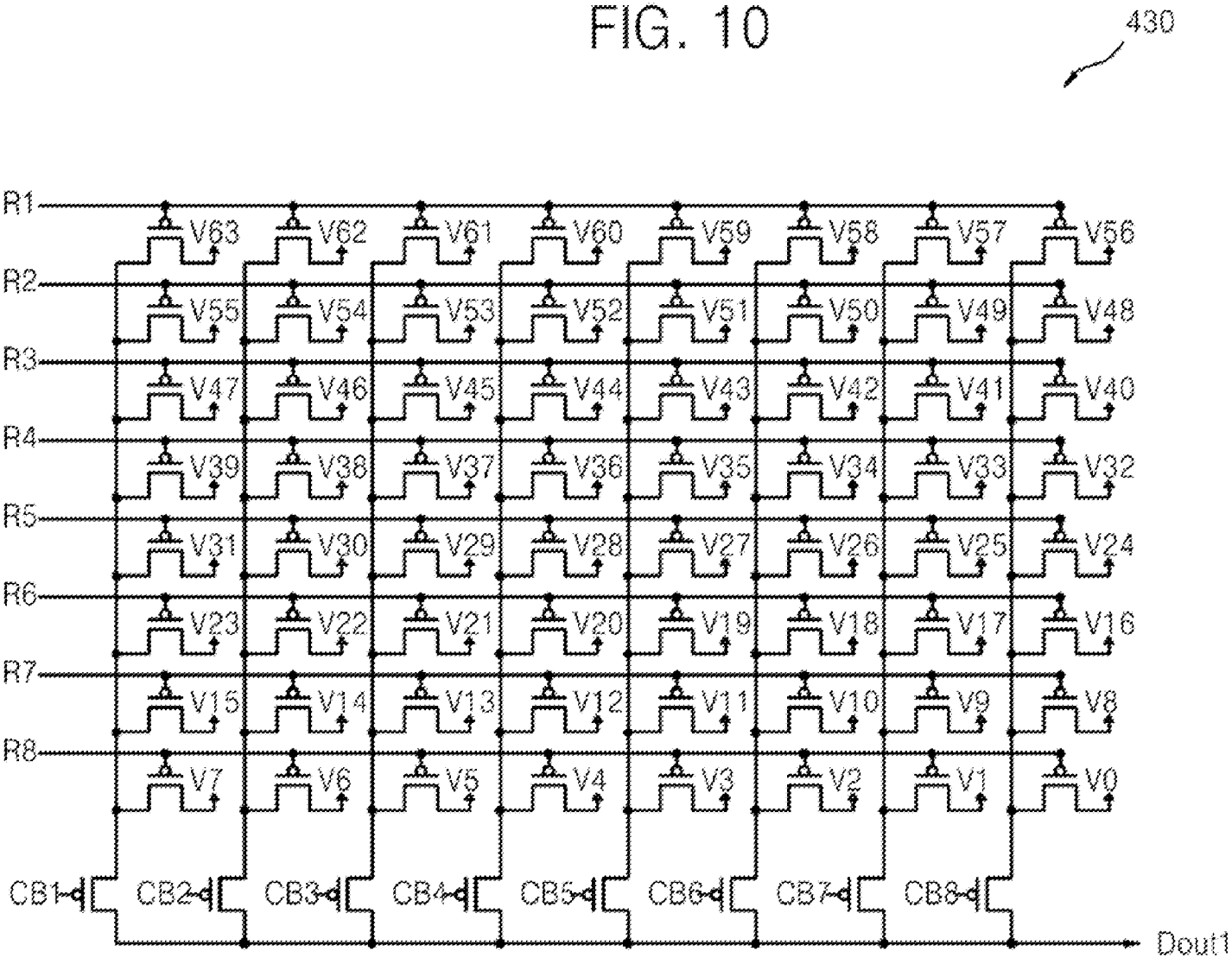
FIG. 10 is a circuit diagram of a 8×8 matrix type DAC block of FIG. 6.

FIG. 10 is a circuit diagram of the 8×8 matrix type DAC block 430 of FIG. 6. Referring to FIG. 10 the 8×8 matrix type DAC block 430 includes a plurality of NMOS transistors. The NMOS transistors are turned on or off based on the signals CB1 through CB8 output from the first level shifting unit 420 and the signals RB1 through RB8 output from the second level shifting unit 425.

The 8×8 matrix type DAC block 430 selects and outputs one of the 64-level grayscale voltages V0 through V63 generated from the grayscale voltage generation unit 65 based on the turning on or off of the NMOS transistors. For example, when the signals CB1 through CB8 output from the first level shifting unit 420 are 1110111 and the signals RB1 through RB8 output from the second level shifting unit 425 is 10111111, the output out1 of the 8×8 matrix type DAC block 430 is V52.

The 8×8 matrix type DAC block 430 of FIG. 10 is merely an exemplary embodiment of the present invention and can be embodied by a plurality of PMOS transistors where the first data code C1 through C8 and the second data code R1 through R8 are respectively decoded to include one bit having the second logic level, i.e., the logic low level "0". Also, the first data code C1 through C8 and the second data code R1 through R8 can be respectively decoded to include two or more bits having the first logic level, i.e. the logic low level "1".

For the 8×8 matrix type DAC block 430 to select one of the 64-level grayscale voltages V0 through Vz, where z=63, the first level shifting block 420 and the second level shifting block 425 can include inverters to invert at least one of the outputs of the first level shifters 621 through 624 and the second level shifters 625 through 628. Since the 8×8 matrix type DAC block 430 uses a total of 72 transistors, the number of transistors is reduced compared to the DAC block 60 of FIG. 2, i.e., the binary search DAC uses 128 transistors.

To output the grayscale voltage, in the 8×8 matrix type DAC block 430, there is a uniform voltage drop by only two transistors. However, for the binary search DAC block 60, the data path is not uniform and the voltage drop is generated by two to six transistors. Thus, the grayscale voltage output from the 8×8 matrix type DAC block 430 is more accurate than that output from the binary search DAC block 60.

A source driver module can include a plurality of source drivers and each of the source drivers may be the source driver 400 of FIG. 6. A display device can include a display panel, a gate driver, and source drivers. The display panel may include a plurality of gate lines, a plurality of source lines, and a plurality of pixels.

Figure 11:
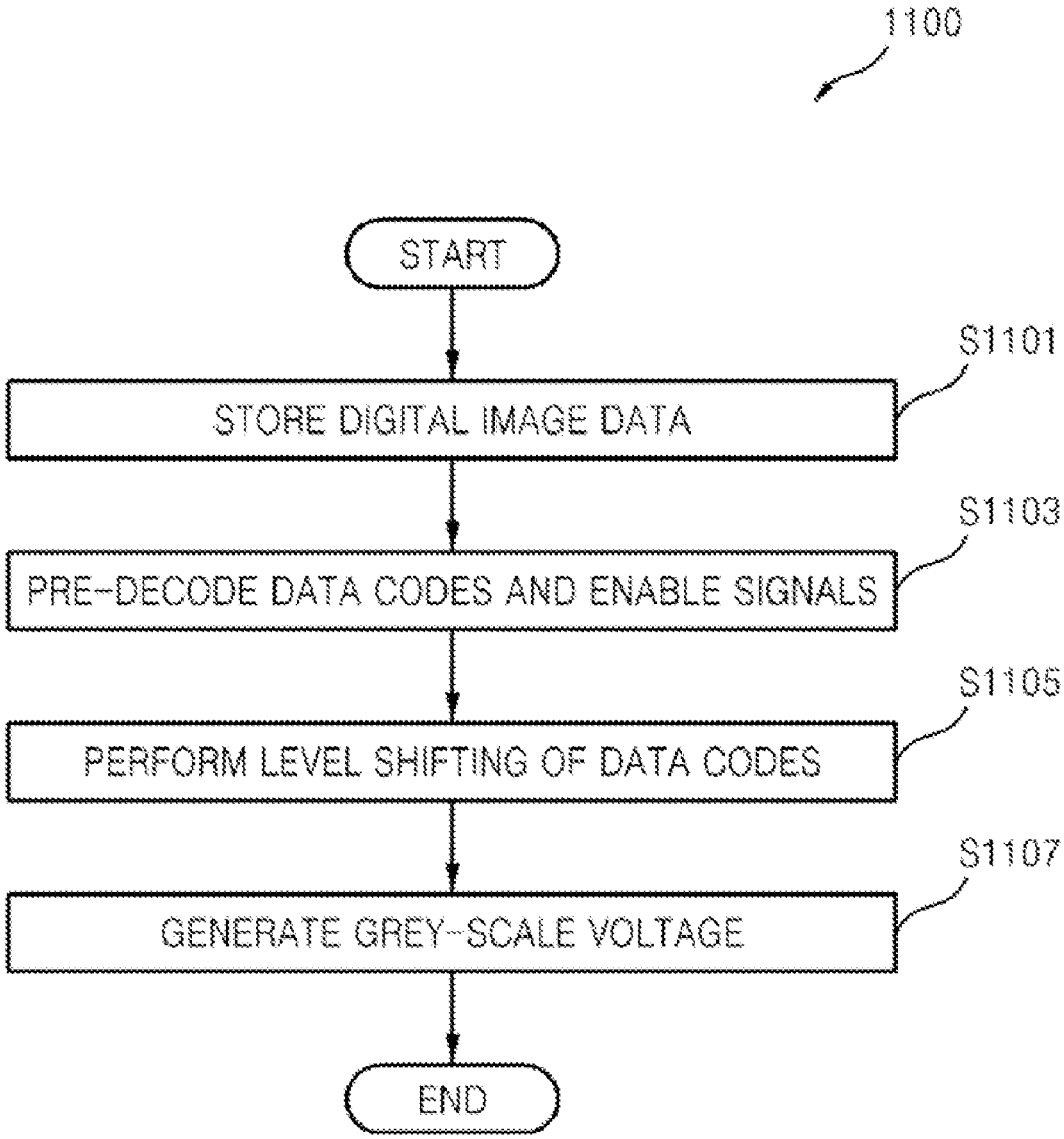
FIG. 11 is a flowchart for explaining a method for performing level shifting of the digital image data in the source driver of FIG. 4.

FIG. 11 is a flowchart for explaining a method for performing level shifting of the digital image data D1 through Dm in the source driver 400 of FIG. 4. Referring to FIG. 11 the source driver 400 stores the m-bit digital image data D1 through Dm (S1101). The source driver 400 generates the data codes C1 through Ck and R1 through Rk that include at least one bit having the first logic level, for example, 1, based on the digital image data D1 through Dm and generates the enable signals E1 through Ex and E1' through Ex' based on the data codes C1 through Ck and R1 through Rk (S1103). The source driver 400 performs level shifting of the data codes C1 through Ck and R1 through Rk based on the enable signals E1 through Ex and E1' through Ex' (S1105). The source driver 400 generates a grayscale voltage selected based on the level shifted data codes CB1 through CBk and RB1 through RBk (S1107).

According to at least one exemplary embodiment of the present invention a source driver, a source driver modules and a display device can reduce the peak current generated from a level shifter according to the transition of the digital image data. Further, by using a matrix type DAC, the voltage drop of a grayscale voltage can be reduced compared to when a binary search DAC is used.

While this invention has been particularly shown and described with reference to exemplary embodiments thereof, it will be understood by those skilled in the art that various changes in form and details may be made therein without departing from the spirit and scope of the invention as defined by the appended claims.

What is claimed is:

1. A source driver, comprising:

a hold memory block storing digital image data;

a first pre-decoding unit receiving lower bits of the digital image data from the memory block, wherein the first pre-decoding unit generates a plurality of first data codes from the lower bits and a plurality of first enable signals from the first data codes, and generates each first enable signal by performing a logical operation on each distinct pair of consecutive bits of the first data codes;

a second pre-decoding unit receiving upper bits of the digital image data from the memory block, wherein the lower bits are distinct from the upper bits, wherein the second decoding unit generates a plurality of second data codes from the upper bits and a plurality of second enable signals from the second data codes, and generates each second enable signal by performing a logical operation on each distinct pair of consecutive bits of the second data codes;

a plurality of first level shifters receiving the first data codes and the first enable signals, wherein each first level shifter receives a corresponding one of the distinct pairs of bits of the first data codes and the first enable signal derived from the corresponding pair and performs a level shifting on the received bits using the received first enable signal to generate a first level shifted data code;

a plurality of second level shifters receiving the second data codes and the second enable signals, wherein each second level shifter receives a corresponding one of the distinct pairs of bits of the second data codes and the second enable signal derived from the corresponding pair and performs a level shifting on the received bits using the received second enable signal to generate a second level shifted data code; and a digital-to-analog converter (DAC) block receiving the first level shifted data codes, the second level shifted data codes and a plurality of grayscale voltages and outputting one of the grayscale voltages based on the first level shifted data codes and the second level shifted data codes.

2. The source driver of claim 1, wherein the DAC block is a matrix type DAC which selects the grayscale voltage from grayscale voltages having a plurality of level values based on the level shifted first and second data codes.

3. The source driver of claim 1, wherein the first pre-decoding unit is configured to maintain only one of the first level shifters in an active state and the other first level shifters in an idle state and wherein the second pre-decoding unit is configured to maintain only one of the second level shifters in the active state and the other second level shifters in the idle state.

4. The source driver of claim 1, wherein each pre-decoding unit comprises:

a first inverter receiving a first one of the corresponding bits;

a second inverter receiving a second one of the corresponding bits;

a first NAND gate receiving the first bit and the second bit;

a second NAND gate receiving the second bit and an output of the first inverter;

a third NAND gate receiving the first bit and an output of the second inverter;

a fourth NAND gate receiving the output of the first inverter and the output of the second inverter;

a plurality of pairs of NOR gates each receiving a third one of the corresponding bits and an output of a corresponding one of the NAND gates; and a plurality of NOR gates each receiving outputs of a corresponding one of the pairs.

5. The source driver of claim 1, wherein each level shifter comprises:

a first complementary transistor connected between a supply voltage and a first node;

a second complementary transistor connected between the supply voltage and the first node;

a third complementary transistor connected between the supply voltage and a second node;

a fourth complementary transistor connected between the supply voltage and the second node;

a fifth complementary transistor connected between the supply voltage and a third node;

a sixth complementary transistor connected between the supply voltage and a fourth node;

a first non-complementary transistor connected between the first node and a ground voltage;

a second non-complementary transistor connected between the second node and the ground voltage;

a third non-complementary transistor connected between the third node and the ground voltage; and a fourth non-complementary transistor connected between the fourth node and the ground voltage.

6. The source driver of claim 5, wherein a gate of the first complementary transistor is connected to the third node, wherein a gate of the second complementary transistor is connected to the second node, wherein a gate of the third complementary transistor is connected to the first node, wherein a gate of the fourth complementary transistor is connected to the fourth node, wherein a gate of the fifth complementary transistor is connected to the first node, wherein a gate of the sixth complementary transistor is connected to the second node, wherein a gate of the first non-complementary transistor receives a first one of the corresponding bits, wherein a gate of the second non-complementary transistor receives a second one of the corresponding bits, wherein a gate of the third non-complementary transistor receives a corresponding one of the enable signals, and wherein a gate of the fourth non-complementary transistor receives the corresponding one of the enable signals.

7. The source driver of claim 1, wherein each level shifted code has a first logic level when the corresponding received bits both have a same second logic level, wherein the first logic level differs from the second logic level.

8. A source driver module, comprising:

a plurality of source drivers, wherein each of the source drivers comprise:

a hold memory block storing digital image data;

a pre-decoding block generating a data code including at least one bit having a first logic level based on the digital image data and generating a plurality of enable signals based on the data code;

a level shifting block performing level shifting of the data code based on the enable signals; and a digital-to-analog converter (DAC) block outputting a grayscale voltage selected based on the level shifted data code output from the level shifting block, wherein the pre-decoding block generates each enable signal by performing a logical operation on each distinct pair of consecutive bits of the data code.

9. The source driver module of claim 8, wherein the level shifting block performs a level shifting on each distinct pair of bits using a corresponding one of the enable signals to generate a level shifted data code.

10. The source driver module of claim 8, wherein the level shifting block includes a plurality of level shifters and the pre-decoding block is configured to maintain only one of the level shifters in an active state and the other level shifters in an idle state at a time.

11. The source driver of claim 8, wherein the pre-decoding block comprises:

a first inverter receiving a first bit of the digital image data;

a second inverter receiving a second bit of the digital image data;

a first NAND gate receiving the first bit and the second bit;

a second NAND gate receiving the second bit and an output of the first inverter;

a third NAND gate receiving the first bit and an output of the second inverter;

a fourth NAND gate receiving the output of the first inverter and the output of the second inverter;

a plurality of pairs of NOR gates each receiving a third bit of the digital image data and an output of a corresponding one of the NAND gates; and a plurality of NOR gates each receiving outputs of a corresponding one of the pairs.

12. A display device comprising:

a display panel having a plurality of gate lines, a plurality of source lines, and a plurality of pixels;

a gate driver driving the gate lines; and a plurality of source drivers electrically connected to the source lines, wherein each of the source drivers comprises:

a hold memory block storing digital image data;

a pre-decoding block generating a data code including at least one bit having a first logic level based on the digital image data and generating a plurality of enable signals based on the data code;

a level shifting block performing level shifting of the data code based on the enable signals;

a digital-to-analogue converter (DAC) block outputting a grayscale voltage selected based on the level shifted data code output from the level shifting block; and an output buffer block outputting the grayscale voltage output from the DAC block to a corresponding source line of the plurality of source drivers, wherein the level shifting block includes a plurality of level shifters and each level shifter performs a level shifting on distinct pairs of consecutive bits of the data code using a corresponding one of the enable signals to generate level shifted data codes.

13. The display device of claim 12, wherein the pre-decoding block generates each enable signal by performing a logical operation on each distinct pair.

14. The display device of claim 12, wherein the level shifting block includes a plurality of level shifters and the pre-decoding block is configured to maintain only one of the level shifters in an active state and the other level shifters in an idle state at a time.

15. A method for performing level shifting of digital image data of a source driver, the method comprising:

generating by a decoding unit first data codes based on lower bits of the digital image data;

generating by the decoding unit second data codes based on upper bits of the digital image data, wherein the upper bits are distinct from the lower bits;

generating by the decoding unit a plurality of first enable signals based on the first data codes, wherein each first enable signal is generated by the decoding unit performing a logical operation on each distinct pair of consecutive bits of the first data codes;

generating by the decoding unit a plurality of second enable signals based on the second data codes, wherein each second enable signal is generated by the decoding unit performing a logic operation on each distinct pair of consecutive bits of the second data codes;

performing level shifting of the first data codes based on the first enable signals;

performing level shifting of the second data codes based on the second enable signals;

outputting one of a plurality of grayscale voltages based on the first level shifted data codes and the second level shifted data codes.

16. The method of claim 15, wherein each level shifting further comprises inverting a voltage of at least one bit of voltages of neighboring bits of the level shifted data codes.

17. The method of claim 15, wherein the level shifting of the first data codes and the second data codes comprises:

performing by a plurality of first level shifters a level shifting on each distinct pair of bits of the first data codes using its corresponding first enable signal to generate the first level shifted data codes; and performing by a plurality of second level shifters a level shifting on each distinct pair of bits of the second data codes using its corresponding second enable signal to generate the second level shifted data codes.

18. The method of claim 17, wherein each generated level shifted code has a first logic level when the bits received by the corresponding level shifter are both a same second logic level, wherein the first logic level differs from the second logic level.

19. The method of claim 18, further comprising maintaining by the decoding unit only one of the first level shifters and only one of the second level shifters in an active state and the other first level shifters and the other second level shifters in an idle state.

* * * * *